US005973715A

United States Patent [19]

Ghosh et al.

[11] Patent Number: 5,973,715

[45] Date of Patent: Oct. 26, 1999

[54] IMAGE PROCESSING EQUIPMENT

[75] Inventors: Syamal K. Ghosh, Rochester; Edward P. Furlani, Lancaster; Dilip K. Chatterjee, Rochester, all of N.Y.

[73] Assignee: Eastman Kodak Company, Rochester, N.Y.

[21] Appl. No.: 09/090,850

[22] Filed: Jun. 4, 1998

[51] Int. Cl.[6] ..... B41J 17/00; B41J 33/00; B41J 33/14

[52] U.S. Cl. ..... 347/218; 347/217; 347/262; 347/264

[58] Field of Search ..... 347/220, 218, 347/171, 262, 264, 217; 400/662, 223

[56] References Cited

U.S. PATENT DOCUMENTS 5,755,520 5/1998 Furlani et al. ..... 400/354
5,812,175 9/1998 Kerr et al. ..... 347/238
5,818,497 10/1998 Kerr et al. ..... 347/234
5,829,881 11/1998 Furlani et al. ..... 384/12
5,838,345 11/1998 Kerr et al. ..... 347/37

OTHER PUBLICATIONS

U.S. application No. 09/047,842, Ghosh et al., filed Mar. 25, 1998.

*Primary Examiner*—Huan Tran
*Attorney, Agent, or Firm*—Clyde E. Bailey, Sr.

[57] ABSTRACT

Image processing equipment (10) having an image processor housing (20) and a transport roller assemblage (100) for transporting a web (116) of donor dye material (44) arranged in the housing. The transport roller assemblage (100) has at least one of either the first and second rollers (112, 114) comprising a composite mixture of polymer and inorganic particulate materials (172). Alternatively, a hard coating (182, 184) is applied on a polymeric roller comprising primarily hard inorganic particles.

19 Claims, 3 Drawing Sheets

IMAGE PROCESSING EQUIPMENT

FIELD OF THE INVENTION

This invention relates generally to the field of image processing equipment. More particularly, the invention concerns image processing equipment, for instance lathe bed scanners and the like, having abrasive media transport elements, particularly rollers, for conveying abrasive web through various processing stages.

BACKGROUND OF THE INVENTION

Image processing equipment has utility in a wide range of industries. Color-proofing is the procedure used by the printing industry for creating representative images that replicate the appearance of printed images without the cost and time required to actually set up a high-speed, high-volume printing press to print an example of the images intended. One such color proofer is a lathe bed scanner that utilizes a thermal printer having half-tone capabilities. This printer is arranged to form an image on a thermal print medium in which a dye donor material transfers a dye to the thermal print medium upon a sufficient amount of thermal energy. This printer includes a plurality of diode lasers that can be individually modulated to supply energy to selected areas of the medium in accordance with an information signal. The print-head of the printer includes one end of a fiber optic array having a plurality of optical fibers coupled to the diode lasers. The thermal print medium and dye donor material are supported on a rotatable imaging drum, and the print-head with the fiber optic array is movable relative to the longitudinal axis of the drum. The dye is transferred to the thermal print medium as the radiation, transferred from the diode lasers to the dye donor material by the optical fibers, is converted to thermal energy in the dye donor material or media.

The generally abrasive dye donor media is stored in rolls and is transported in the form of a web to the print head via conventional web transport elements. Presently, four different rolls of dye donor media are used, and each roll includes a different dye donor material from among black, yellow, magenta and cyan. These rolls of dye donor media are ultimately cut into dye donor sheets and then transported to the vacuum imaging drum for forming the medium from which dyes imbedded therein are transported to the thermal print media resting thereon. In order to transport the dye donor media, the imaging processing equipment typically includes some sort of web or media transport means operably connected to each roll of dye donor material. Most existing media transport means includes a plurality of closely spaced transport rollers made generally of either steel or plastic. These roller materials, when exposed to corrosive environments existing in image processing equipment, are subject to wear and abrasion that affects the reliability of the imaging process.

One problem associated with current media transport means is that any of the rolls of generally abrasive dye donor media can potentially slip as it is being transferred to the imaging drum. This, of course, could cause misalignment and poor registrability of the image formed on the media and thus loss of expensive media material. Another problem associated with the present media transport means is that the rollers are generally not as durable with continuous exposure to a corrosive environment.

Therefore, a need persists for image processing equipment in which the generally abrasive dye donor media is conveyed during processing to the vacuum image drum by a wear and abrasive resistant means which is reliable, economical and easy to develop, to install and operate.

SUMMARY OF THE INVENTION

It is, therefore, an object of the invention to provide image processing equipment that make use of compliant or semi-compliant rollers for conveying abrasive photographic media, for instance dye donor media, toward a vacuum imaging drum.

It is another object of the invention is to provide image processing equipment in which at least one media bearing surface for conveying the dye donor media therein is coated with semi-compliant mixture of a polymer and hard inorganic particulates for better wear and abrasion resistance.

Still another object of the invention is to provide image processing equipment in which at least one media bearing surface for conveying abrasive dye donor media therein contains a mixture of polymer and hard inorganic particulates for better wear and abrasion resistance.

Yet another object of the invention is to provide image processing equipment in which at least one media bearing surface for conveying abrasive dye donor media therein contains an electrically conductive particulate inorganic materials intended for dissipating static charges.

It is a feature of the invention that image processing equipment in which abrasive media is conveyed therein has at least one media bearing surface for conveying the abrasive dye donor media contains a mixture of polymer and hard inorganic particulates.

Accordingly, for accomplishing these and other objects, features and advantages of the invention, there is provided, in one aspect of the invention, image processing equipment in which generally abrasive dye donor media is conveyed to a vacuum imaging drum via first and second closely spaced rollers wherein at least one of the first and second rollers has a media bearing surface comprising, in a mixture, a polymeric matrix and a hard, inorganic particulate material for contacting the generally abrasive dye donor media.

In another aspect of the invention, imaging processing equipment has cooperative rollers for conveying abrasive dye donor media wherein at least one of the rollers has a media bearing surface composed of a thin inorganic sol-gel coating and an inner layer bonded to the coating.

In yet another aspect of the invention, imaging processing equipment has cooperative rollers for conveying abrasive dye donor media wherein at least one of the rollers has a media bearing surface composed of a coating containing hard, inorganic particulates.

Hence, the image processing equipment of the invention has an important advantage over prior art developments in that the generally abrasive dye donor media is conveyed in the imaging process to a vacuum imaging drum on a wear and abrasion resistant media bearing surface. It is another advantage of the invention is that the media bearing surface is sufficiently compliant to accommodate abrasive media of varying thickness.

BRIEF DESCRIPTION OF THE DRAWINGS

The above and other objects, features and advantages of the present invention will become apparent when taken in conjunction with the following description and drawings wherein identical reference numerals have been used, where possible, to designate identical equipment elements that are common to the figures, and wherein.

DETAILED DESCRIPTION OF THE INVENTION

Figure 1:
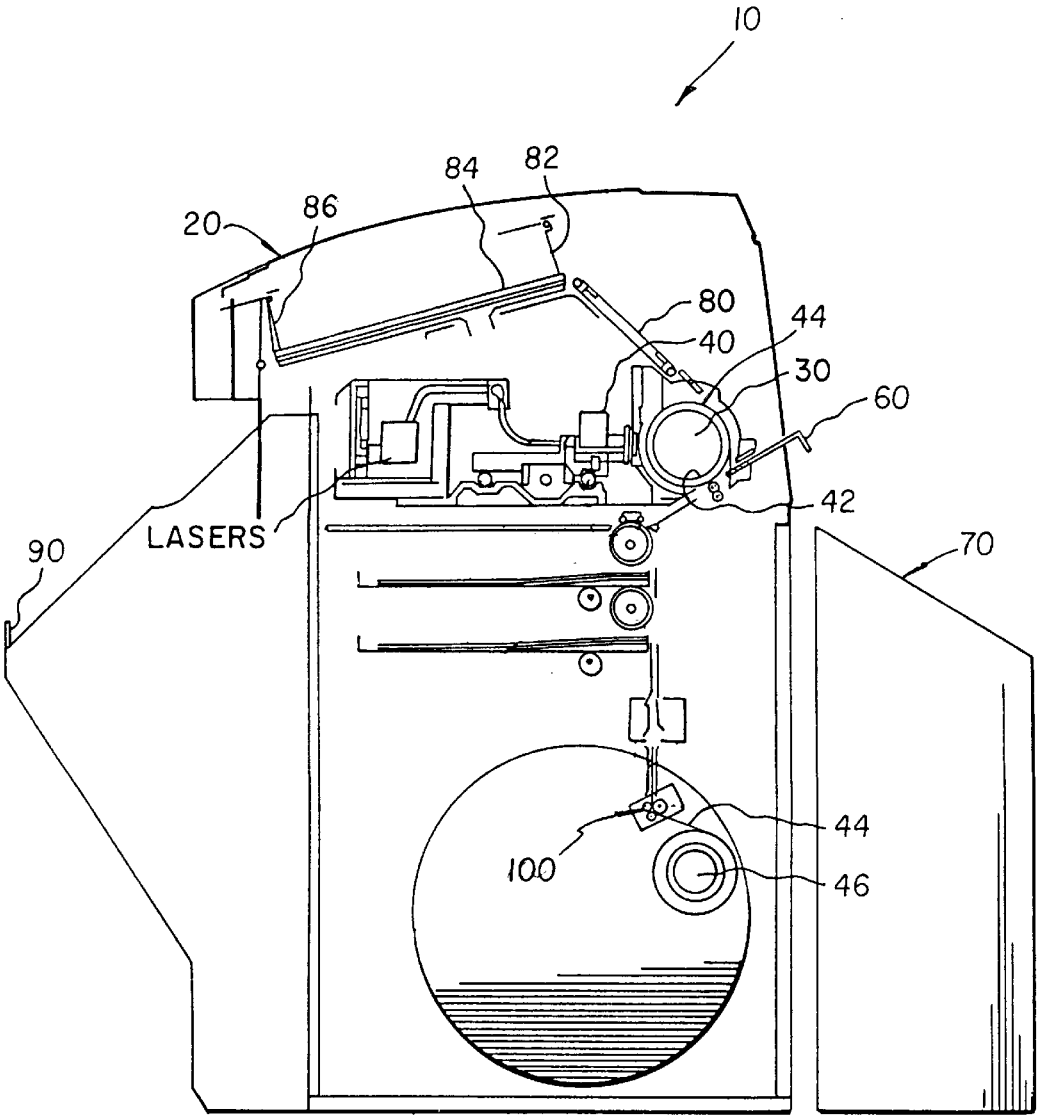
FIG. 1 is a side view in vertical cross section of an image processing apparatus of the present invention.

Referring now to the drawings, more particularly to FIG. 1, there is illustrated image processing equipment 10 according to the principles of the present invention. Broadly defined, image processing equipment 10 has an image processor housing 20 defining a support frame for supporting, in general, a vacuum imaging drum 30 and means, such as a printhead 40 for writing on media which is supported on a rotatable vacuum imaging drum 30 during the write process. For thermal printers, thermal print medium 42 and dye donor material 44 are supported on the imaging drum 30, and the printhead 40 is movable relative to the longitudinal axis of the imaging drum 30. The dye is transferred from the dye donor material 44 to the thermal print medium 42 as the radiation, which transferred from the printhead 40 to the dye donor material 44, is converted to thermal energy in the dye donor material 44. Preferably, a transport roller assemblage 100 arranged in image processor housing 20 advances the generally abrasive dye donor material 44 from the rolls 46 (only one shown) of media to upstream locations in the processing equipment before the media is ultimately deposited onto the vacuum imaging drum 30.

Figure 2:
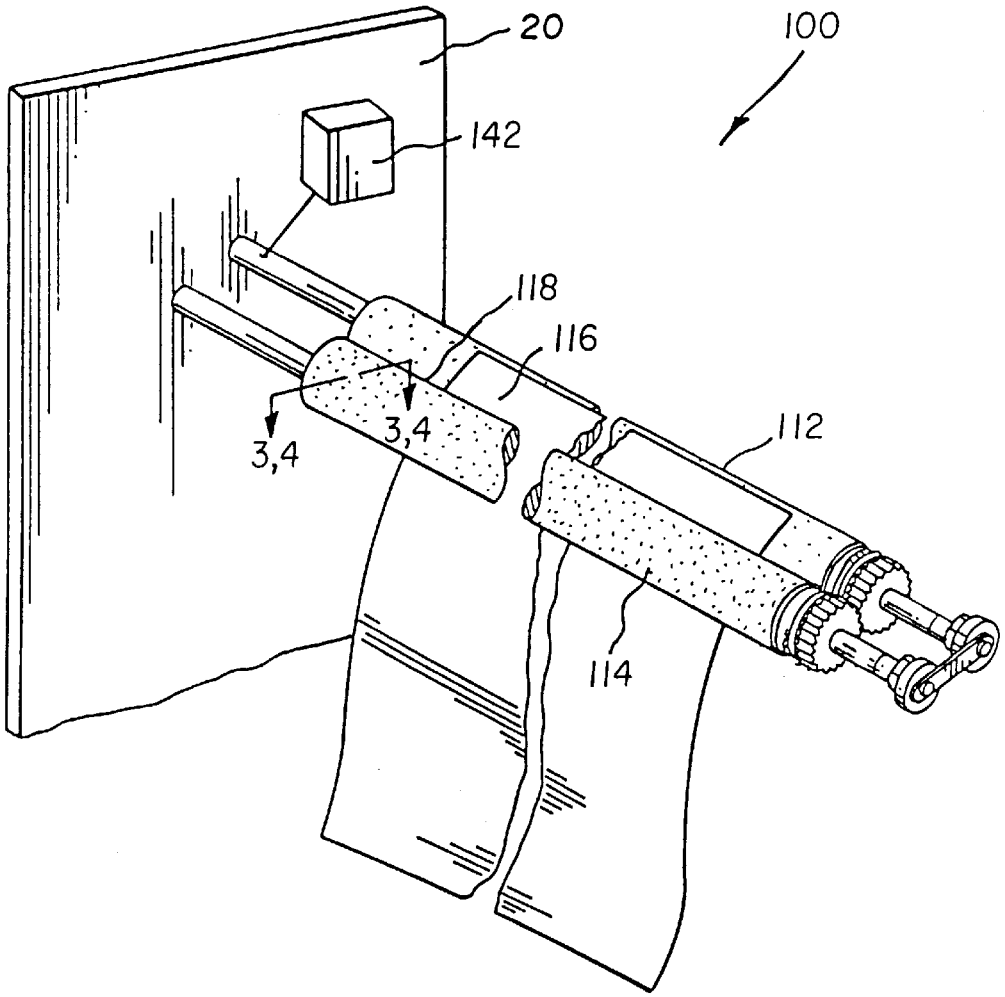
FIG. 2 is a perspective of transport rollers of the invention.

Referring to FIG. 2, a typical transport roller assemblage 100 of the invention for conveying abrasive web 116, such as the dye donor material 44, includes closely spaced first and second rollers 112, 114 supported in processor housing 20. It is within the contemplation of the invention that any one of the first and second rollers 112, 114 has a media bearing surface coated with an inorganic particulate in a polymeric matrix. For clarity, the media bearing surface (designated 170 in FIG. 3 or 180 in FIG. 4) is defined as the outermost surface of the roller on which the dye donor material 44 or web 116 rides as the web 116 is being conveyed through the transport nip or close spacing 118 between the rollers 112, 114. Skilled artisans will appreciate that while both rollers 112, 114 have media bearing surfaces 170, 180 the media bearing surfaces 170, 180 need not include the entire surface area of the roller, but only the active portion of the outermost surface minimally required to promote continuous movement of the abrasive media 116 through the nip 118. It is further within the contemplation of the invention that a plurality of cooperating conveyance rollers (not shown) may have coated media bearing surfaces of the type described herein. Alternatively, the media bearing surfaces 170, 180 may include a thin inorganic coating, as described below. Thus, a media bearing surface 170, 180 having a polymeric/inorganic particulate composite coating (or alternatively, a thin inorganic coating) was selected because it provides sufficient compliancy to accommodate abrasive media of varying thickness. Importantly, as indicated, media bearing surfaces 170, 180 also provides sufficient friction to enable continuous movement of the abrasive media 116 as it is conveyed between the nip 118 of first and second rollers 112, 114. Skilled artisans will appreciate that while any one of rollers 112, 114 (shown in FIG. 2) may have a media bearing surfaces 170, 180 comprising polymeric/inorganic particulate coating or a thin inorganic coating, it is within the contemplation of the invention that both rollers 112, 114 (shown in FIG. 2), or a portion of any of the media bearing coated surfaces 170, 180 (shown in FIGS. 3 and 4, respectively) may comprise any one or both of our preferred wear and abrasion resistant coatings.

Referring again to FIG. 1, imaging processing equipment 10 includes some sort of drive means, such as a drive motor 142 (shown in FIG. 2), operably connected to any one of the first and second rollers 112, 114 for driving at least one of the first and second rollers 112, 114. Synchronous rotation of the other of the first and second roller 112, 114 is produced by the driven roller. As any skilled artisan will appreciate, this rotation of the first and second rollers 112, 114 causes the web 116 to be squeezed between the rollers 112, 114 while in contact with abrasive media bearing surfaces 170, 180 (shown in FIGS. 3 and 4, respectively) for movement through the transport nip 118.

Preferably, the drive mechanism of imaging processing equipment 10 includes those elements, such as gears, ceramic bushings and ceramic sleeves that are described in details in U.S. Ser. No. 09/047,842, filed Mar. 25, 1998, entitled APPARATUS FOR PROCESSING PHOTOGRAPHIC MEDIA, by Syamal K. Ghosh, Dilip K. Chatterjee, and Edward P. Furlani, hereby incorporated herein by reference. The aforementioned arrangement of elements is preferred because of their ability to effectively operate in a corrosive environment.

Figure 3:
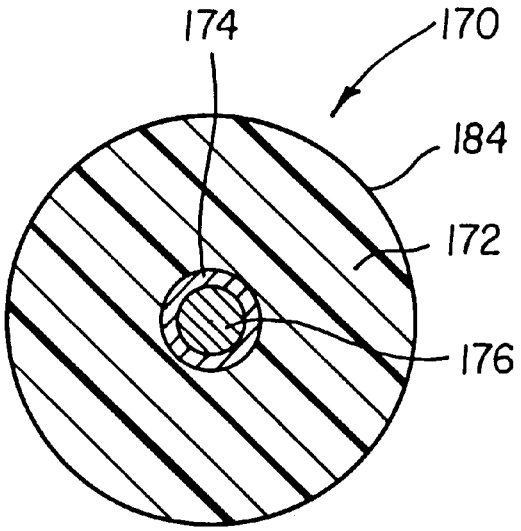
FIG. 3 is a section view taken along line 3—3 of FIG. 2 showing a wear and abrasion resistant coating on the outer surface of a roller; and, FIG. 4 is a section view taken along line 4—4 of FIG. 2 showing wear and abrasion resistant particles embedded in a transport roller.

Turning now to FIG. 3, a cross sectional view is shown of one of the rollers 112, 114 having abrasive media bearing surface 170. Coating 184 is deposited on polymeric substrate 172, which is supported on mandrel 174, which rotates about shaft 176. In the preferred embodiment, media bearing surface 170 comprises a composite coating. While there are a range of composite coatings within the contemplation of the invention, a composite coating containing polyurethane binder mixed with hard inorganic particulates is most preferred, as described below. Other embodiments may include polymeric binders, such as, polyvinyl alcohol, polyalkylene glycols, polyacrylates, and polymethacrylates.

Referring again to FIG. 3, the relatively harder shell or coating 184 of the media bearing surface 170, applied on a polymeric substrate 172, comprises primarily inorganic particles, selected from the group comprising metal oxides, metal carbides, metal nitrides and metal borides. More particularly, such metal composites include silica, titania, zirconia, alumina, silicon carbide, silicon nitride, titanium nitride, titanium diboride, zirconium boride, and a mixture thereof.

With further reference to FIG. 3, polymeric substrate 172 is preferably made of polyurethane. Polymeric substrate 172 may also be made from other materials with similar results including synthetic rubber, polyurethane or a mixture thereof.

Preferably, coating or shell 184, includes one or more polymeric binder materials to adhere or coalesce the inorganic particles in the coating solid form. These polymeric binders are not cross-linkable, but provide a physical bonding among the inorganic particles as well as adhesion to the polymeric substrate 172. Such binder materials include, but are not limited to, polyvinyl alcohol, polyalkylene glycols, polyacrylates, polymethacrylates, and polyurethane. The thickness of the coating or shell 184 is preferably between about 0.25 inch and about 0.001 inch, preferred being 0.01 inches. Further, the Rockwell hardness of coating 184 at 75° F. is preferably in the range between Shore hardness D40 and D75.

For best results, inorganic particle concentration of the shell or coating 184 is preferably in the range of 50 to 95% by weight, most preferably in the range of between 70 to 85% by weight.

Figure 4:
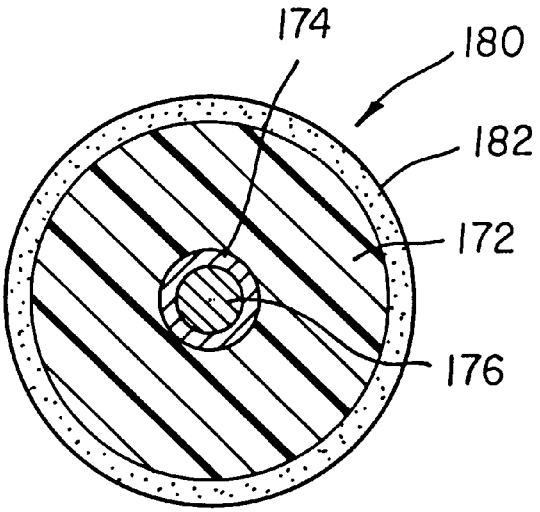

Referring now to FIGS. 3 and 4, in an alternative embodiment, transport roller assemblage 100 (FIG. 2), imaging processing equipment 10 may include at least one of the first and second rollers 112, 114 having a media bearing surface 180 (shown in FIG. 4) comprising a harder (compared to the coating described above) and semi-compliant thin coating 182 applied over a semi-compliant polymeric/inorganic particulate composite substrate 172. The relatively harder shell 182 is selected from the group comprising metal oxides, metal carbides, metal nitrides and metal borides. More particularly, such metal composites include such materials as silica, titania, zirconia, alumina, silicon carbide, silicon nitride, titanium nitride, titanium diboride, zirconium boride, and a mixture thereof. The thin coating 182 may be applied by physical vapor deposition or thermal spray coating. Alternatively, the thin coating 182 may be accomplished by dip coating or spin coating of inorganic sol-gel particles. The sol-gel coating is performed by selecting one or more colloids of titania, zirconia, alumina, silica or a transition metal oxide. Such colloids are obtained from hydroxytitanates, hydroxyzirconates, hydroxyaluminates or hydroxysilicates. Stable dispersions of such materials can be purchased from various commercial sources including DuPont Company. The colloidal dispersion comprising about 5 weight % solids are used and applied onto the substrate by either spin coating or dip coating. The coating is then allowed to dry at about 100° C. for about 1 to 2 hours. Preferably, the thickness of the coating or shell 182 is between about 0.001 inch and about 0.0001 inches. Further, it is preferred that the hardness of the shell 182 be in the range of about Rockwell C30 to about Rockwell C60.

Referring again to FIG. 4, media bearing surface 180 comprises a polymeric/inorganic particulate composite substrate 182 which is formed by mixing inorganic particulate materials, preferably ceramic particles such as alumina, zirconia, silicon carbide, silicon nitride and the like with an organic polymeric slurry comprising rubber, silicone or polyurethane. The mixture is then cast on a metal, preferably aluminum or stainless steel, mandrel 174 which is supported on a shaft 176. The mixture contains preferably at least about 5 weight % inorganic particles and must not exceed about 50 weight % so that the hardness of the composite (polymer+inorganic particles) roller does not exceed Shore hardness A 70, and preferably lies within about 60 and about 70.

Referring once again to FIG. 1, in operations, vacuum imaging drum 30 contained in imaging processing equipment 10 of the invention, for writing, rotates at a constant velocity, and the printhead 40 begins at one end of the thermal print media 42, which is supported on the vacuum imaging drum 30, and traverses the entire length of the thermal print media 42 for completing the transfer process for the particular dye donor sheet material 44 resting on the thermal print media 42. After the printhead 40 has completed the transfer process, the particular dye donor sheet material 44 resting on the thermal print media 42 is then removed from the vacuum imaging drum 30 and transferred out the image processor housing 20 via a skive or ejection chute 60. The dye donor sheet material 44 eventually comes to rest in a waste bin 70 for removal by the user. The above described process is then repeated for the other three rolls 46 of dye donor materials 44.

After the color from all four sheets of the dye donor sheet materials 44 have been transferred, the thermal print media 42 is transported via a transport mechanism 80 through an entrance door 82 to a color binding assembly 84. The entrance door 82 is opened for permitting the thermal print media 42 to enter the color binding assembly 84, and shuts once the thermal print media 42 comes to rest in the color binding assembly 84. The color binding assembly 84 processes the thermal print media 42 for further binding the transferred colors on the thermal print media 42 and for sealing the microbeads thereon. After the color binding process has been completed, a media exit door 86 is opened and the thermal print media 42 with the intended image thereon passes out of the color binding assembly 84 and the image processor housing 20 and comes to rest against a media stop 90.

The invention has been described in detail with particular reference to certain preferred embodiments thereof, but it will be understood that variations and modifications can be effected within the spirit and scope of the invention.

PARTS LIST

| | |
|---|---|
| 10 | Image processing equipment |
| 20 | Image processor housing |
| 30 | Vacuum imaging drum |
| 40 | Printhead |
| 42 | Thermal print medium or media |
| 44 | Dye donor material |
| 46 | Roll of dye donor roll material |
| 60 | Skive or ejection shoot |
| 70 | Waste bin |
| 80 | Transport mechanism |
| 82 | Media entrance door |
| 84 | Color binding assembly |
| 86 | Media exit door |
| 90 | Media stop |
| 100 | Transport roller assemblage |
| 112 | First roller |
| 114 | Second roller |
| 116 | Abrasive web or media |
| 118 | Transport nip or close spacing |
| 142 | Drive motor |
| 170 | Media bearing surface |
| 172 | Inorganic-polymer composite |
| 174 | Metal mandrel |
| 176 | Shaft |
| 180 | Media bearing surface |
| 182 | Shell or coating |
| 184 | Shell or coating |

What is claimed is:

1. An image processing equipment, comprising:

(a) a housing;

(b) a vacuum imaging drum arranged in said housing;

(c) means for writing on said imaging drum;

(d) means for transporting abrasive media toward said vacuum imaging drum, said means for transporting comprising first and second closely spaced rollers mounted for synchronous rotation in said housing, wherein at least one of said first and second rollers has a media bearing surface comprising, in a mixture, a polymeric matrix and a hard, inorganic particulate material for contacting said abrasive media; and, (e) a drive means operably connected to any one of said first and second rollers for driving at least one of said first and second rollers thereby causing the synchronous rotation of the other of said first and second rollers, whereby rotation of said first and second rollers causes said web to be squeezed for movement through said transport nip in contact with said media bearing surface while advancing toward said vacuum imaging drum.

2. The image processing equipment recited in claim 1, wherein said inorganic particulate material is selected from the group consisting of:

(a) alumina;

(b) silicon carbide;

(c) silicon nitride;

(d) zirconia;

(e) titania; and, (f) mixture thereof.

3. The image processing equipment recited in claim 1, wherein said polymeric matrix is selected from the group consisting of:

(a) synthetic rubber;

(b) silicone;

(c) polyurethane; and, (d) mixture thereof.

4. The image processing equipment recited in claim 1 wherein said inorganic particulate is in said mixture at a concentration in a range of between about 5% by weight and 50% by weight.

5. The image processing equipment recited in claim 1 wherein said inorganic particulate has a concentration of 20 weight %.

6. The image processing equipment recited in claim 1 wherein said at least one of said first and second rollers has a Shore hardness A in the range of about 60 to about 95.

7. Image processing equipment, comprising:

(a) a housing;

(b) a vacuum imaging drum arranged in said housing;

(c) means for writing on said imaging drum;

(d) means, in proximity to said vacuum imaging drum, for transporting abrasive media to said imaging drum, said means for transporting comprising first and second closely spaced rollers mounted for synchronous rotation in said housing, wherein at least one of said first and second rollers has a media bearing surface comprising a coating containing hard, inorganic particulates for contacting said abrasive media; and, (e) a drive means operably connected to any one of said first and second rollers for driving at least one of said first and second rollers thereby causing the synchronous rotation of the other of said first and second rollers, whereby rotation of said first and second rollers causes said abrasive media to be squeezed for movement through said nip in contact with said media bearing surface while advancing toward said vacuum imaging drum.

8. The image processing equipment recited in claim 7, wherein the hard inorganic particulates are selected from the group consisting of: metal oxides, metal carbides, metal nitrides, metal borides, and mixtures thereof.

9. The image processing equipment recited in claim 8 wherein said metal oxides are selected from the group consisting of: alumina; zirconia; silica; titania; and mixture thereof.

10. The image processing equipment recited in claim 8 wherein said metal carbides are selected from the group consisting of: silicon carbide; titanium carbide; and a mixture thereof.

11. The image processing equipment recited in claim 8 wherein said metal nitrides are selected from the group consisting of: silicon nitride; titanium nitride; and a mixture thereof.

12. The image processing equipment recited in claim 8 wherein said metal borides are selected from the group consisting of: titanium boride; zirconium boride; and mixture thereof.

13. The image processing equipment recited in claim 8 wherein said hard inorganic particulates is in said mixture at a concentration of between about 50% by weight and about 95% by weight.

14. The image processing equipment recited in claim 7 wherein the polymeric material is selected from the group consisting of: polyvinyl alcohol; polyalkylene glycols; polyacrylates; polymethacrylates; polyurethane; and a mixture thereof.

15. The image processing equipment recited in claim 7 wherein said inorganic particulate coating has a Shore D hardness in the range of between 40 and 75.

16. An image processing equipment, comprising:

(a) a housing;

(b) a vacuum imaging drum arranged in said housing;

(c) means for writing on said imaging drum;

(d) means for transporting abrasive media toward said vacuum imaging drum, said means for transporting comprising first and second closely spaced rollers mounted for synchronous rotation in said housing, wherein at least one of said first and second rollers has a media bearing surface comprising a thin inorganic sol-gel coating and an inner polymeric layer bonded to the media bearing surface; and (e) a drive means operably connected to any one of said first and second rollers for driving at least one of said first and second rollers thereby causing the synchronous rotation of the other of said first and second rollers, whereby rotation of said first and second rollers causes said web to be squeezed for movement through said transport nip in contact with said media bearing surface while advancing toward said vacuum imaging drum.

17. The image processing equipment recited in claim 16 wherein said sol-gel coating is a metal oxide.

18. The image processing equipment recited in claim 17 wherein said metal oxide is selected from the group consisting of: alumina; zirconia; silica; titania; and mixture thereof.

19. The image processing equipment recited in claim 16 wherein said sol-gel coating has a surface hardness in the range of between Rockwell C 30 to about Rockwell C 60.

* * * * *